US005822670A

United States Patent [19]

Morigami

[11] Patent Number: 5,822,670

[45] Date of Patent: Oct. 13, 1998

[54] FIXING DEVICE AND IMAGE FORMING APPARATUS

[75] Inventor: Yuusuke Morigami, Toyohashi, Japan

[73] Assignee: Minolta Co., Ltd., Osaka, Japan

[21] Appl. No.: 783,051

[22] Filed: Jan. 14, 1997

[51] Int. Cl.[6] ..... G03G 15/08

[52] U.S. Cl. ..... 399/334; 399/330; 399/335

[58] Field of Search ..... 399/67, 69, 70, 399/320, 328, 330, 334, 333, 335

[56] References Cited

U.S. PATENT DOCUMENTS

| | | | |
|---|---|---|---|
| 4,585,325 | 4/1986 | Euler | 399/69 |
| 4,801,968 | 1/1989 | Kogure et al. | 399/334 |
| 4,820,904 | 4/1989 | Urban | 399/335 X |
| 5,041,718 | 8/1991 | d'Hondt et al. | 399/330 X |
| 5,300,996 | 4/1994 | Yokoyama et al. | 399/69 |
| 5,402,220 | 3/1995 | Tanaka et al. | 399/335 X |

*Primary Examiner*—Sandra L. Brase
*Attorney, Agent, or Firm*—McDermott, Will & Emery

[57] ABSTRACT

A fixing device for heating and fixing an unfixed image to a record medium bearing the unfixed image, includes a heating roller provided with a core roller and at least two resistance heating members arranged at the core roller and controlled to be electrically powered independently of each other, the resistance heating members provide different heat distributions in a direction of a rotation axis of the heating roller.

25 Claims, 8 Drawing Sheets

FIXING DEVICE AND IMAGE FORMING APPARATUS

BACKGROUND OF THE INVENTION

1. Field of the Invention

The present invention relates to a fixing device, which can be employed in electrophotographic image forming apparatuses such as a copying machine, printer and facsimile for heating and thereby fixing an unfixed image to a record member bearing the unfixed image, and also relates to an image forming apparatus employing such a fixing device.

2. Description of the Background Art

A fixing device in an image forming apparatus such as a printer, a copying machine or a facsimile, which electrophotographically forms printed images, generally includes a heating roller for heating and fixing an unfixed image to a record member. The record member bearing the unfixed image such as a toner image is moved between the heating roller and a backup member (generally, a pressure roller, pressure belt, a pressure plate or the like) opposed thereto, so that the unfixed image is heated and fixed by the pressure.

In many cases, the heating roller includes a heater such as a halogen lamp heater, and the roller is heated by heat radiated from the heater.

In the above fixing device, however, the heating roller containing the heater such as a halogen lamp heater as a heat source cannot rapidly heat a surface of the heating roller to a predetermined fixing temperature after start of power supply to the heater, so that a long preheating time (i.e., a warming-up time) is required before the fixing device reaches the predetermined temperature after power-on of the image forming apparatus. This prevents easy operation of the apparatus. In order to reduce the temperature rising time before attaining a predetermined temperature, such a heating roller has recently been employed that includes a core roller and a resistance heating member, which is made of a material generating heat when a current flows therethrough, and is arranged for integral rotation with the core roller. The heating roller of this type has a good electrothermal converting efficiency, and can rapidly raise the surface temperature of the heating roller to a predetermined temperature after current supply to the resistance heating member, so that the preheating time of the fixing device can be reduced.

Aside from the reduction of the warming-up time, there has been such a problem that a temperature abnormally rises at a region (which will be referred to as a "sheet non-passage region") outside a region (which will be referred to as a "sheet passage region") at the surface of the heating roller over which a record medium travels. More specifically, temperature control of the heating roller surface is generally performed in such a manner that temperature detecting means detects a surface temperature of a common region over which sheets of various sizes are to be passed, and the surface temperature of the heating roller is controlled to attain a predetermined fixing temperature based on the detected temperature. After many record mediums of a small size passed over the sheet passage region, the surface temperature at this region of the heating roller lowers, so that the temperature control means controls the surface temperature of the heating roller to compensate the temperature lowering based on the temperature information detected by the temperature detecting means. As a result, the surface temperature of the heating roller at the sheet non-passage region gradually increases to an abnormally high temperature in spite of the fact that the surface region of the heating roller for passage of the record mediums of small sizes is kept at an appropriate temperature, because the record medium which removes the heat does not pass over the sheet non-passage region. Due to this abnormal temperature rising, the heating roller and parts around the same may be thermally damaged, and/or the record mediums of a large size, which will be subsequently supplied, may be thermally damaged. Even if the thermal damage on the record medium is prevented, toner forming an image may be excessively melted and thus excessively transferred to the heating roller (i.e., offset may occur). This problem may be caused by both the heating roller, in which the foregoing halogen lamp heater is incorporated as a heat source, and the heating roller, in which the resistance heating member for generating the heat when a current flows therethrough is arranged for integral rotation with the core roller.

In view of the above, such a fixing device has been proposed that includes a heating roller provided with a resistance heating member having the foregoing structure, and a range of power supplied to the resistance heating member can be changed. According to this fixing device, a current can be supplied only to a portion (sheet passage region) of the resistance heating member for a record medium of a small size when an unfixed image is to be fixed to the record medium of a small size. Therefore, it is not necessary to supply a current to a sheet non-passage region, so that abnormal rising of the temperature can be prevented at the sheet non-passage region.

However, according to the fixing device in which a range of the current supplied to the resistance heating member can be changed in accordance with the size of the record medium, the current is supplied to the entire resistance heating member, when a record medium of a large size is to be passed after passage of a record medium of a small size. If the temperature detecting means for controlling the surface temperature of the heating roller is arranged for the region for the small record medium, the temperature of the heating roller is controlled based on the detected temperature of the region for the small record medium even when a record medium of a large size is to be passed. In this case, the portion of the resistance heating member forming the sheet non-passage region for the record medium of a small size cannot be rapidly heated to a predetermined temperature. In the structure where the temperature detecting means is arranged at the sheet non-passage region (forming the sheet passage region for a record medium of a large size), the temperature of the heating roller is controlled based on the temperature of this region, so that abnormal rising of the temperature may occur at the passage region for the small record medium.

SUMMARY OF THE INVENTION

Accordingly, an object of the invention is to provide a fixing device for heating and fixing an unfixed image to a record medium bearing the unfixed image, and particularly a fixing device in which a surface portion of a heating roller at a region for passing the record medium can be rapidly heated to a predetermined temperature under the control based on a size of the record medium supplied to the fixing device.

Another object of the invention is to provide a fixing device for heating and fixing an unfixed image to a record medium bearing the unfixed image, and particularly a fixing device, in which abnormal rising of a temperature can be prevented at respective portions of a heating roller including a surface portion of the heating roller at a region, over which the record medium is not to be passed, under the control based on a size of the record medium supplied to the fixing device, and thereby it is possible to suppress sufficiently thermal damages of the heating roller, parts around the same and the record medium as well as offset of an image.

Still another object of the invention is to provide a fixing device for heating and fixing an unfixed image to a record medium bearing the unfixed image, and particularly a fixing device, in which a fixed image of a good quality can be formed safely and stably.

Further another object of the invention is to provide an image forming apparatus having a fixing device for heating and fixing an unfixed image to a record medium bearing the unfixed image, and particularly an image forming apparatus, in which image formation can be performed safely and stably.

In order to achieve the above objects, the present invention provides a fixing device for heating and fixing an unfixed image to a record medium bearing the unfixed image, and particularly a fixing device including a heating roller provided with a core roller and at least two resistance heating members arranged at the core roller and controlled to be electrically powered independently of each other, wherein the resistance heating members provide different heat distributions (generated heat distributions) in a direction of a rotation axis of the heating roller.

According to the fixing device of the invention, at least one resistance heating member on the heating roller is electrically powered depending on the size of the record medium (e.g., paper sheet or the like) bearing the image to be fixed. Thereby, at least a region at the surface of heating roller, over which the record medium of the above size is to be passed, is heated to a predetermined fixing temperature. While this state is kept, the record medium bearing the unfixed image is supplied, and the heating roller heats and fixes the unfixed image to the record medium. The heating roller is heated by a heat source formed of the resistance heating members arranged at the core roller. Therefore, an intended portion of the heating roller surface can be rapidly heated to a predetermined temperature.

The respective resistance heating members of the heating roller can be controlled to be powered independently of each other, and provide different heat distributions in the direction of the rotation axis of the heating roller, respectively. Therefore, the surface portion of the heating roller, over which the record medium passes, can be rapidly heated to and maintained at a predetermined fixing temperature in accordance with a size of the record medium. Meanwhile, a region, over which the record medium does not currently pass, can be kept at a safe temperature, for example, lower than the predetermined fixing temperature or not causing heating. In this manner, abnormal rising of the temperature can be prevented at various portions of the heating roller. Therefore, a fixed image of a good quality can be formed safely and stably while preventing or suppressing sufficiently thermal damages of the heating roller, parts around the same and the record medium as well as offset of the image.

In order to achieve the above object, the present invention provides an image forming apparatus provided with the above fixing device. The image forming apparatus provided with the fixing device according to the invention can perform image formation safely and stably.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
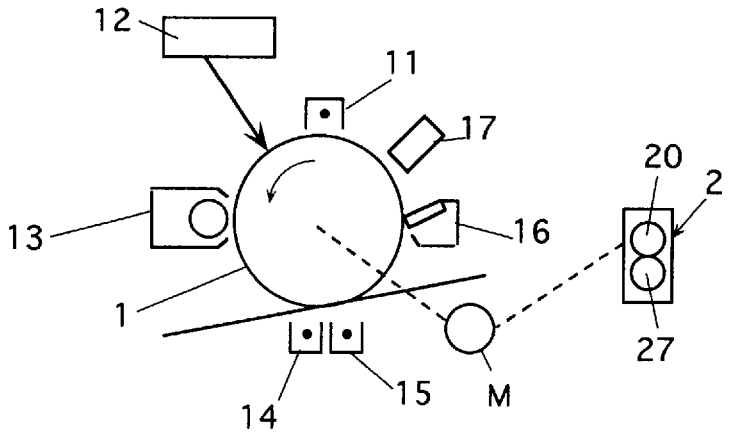
FIG. 1 schematically shows an example of a printer of the invention provided with a fixing device according to the invention.

The fixing device of the above invention will be described below more in detail.

The two or more resistance heating members may be arranged at the core roller, for example, in the following form (1), (2) or (3).

(1) The core roller is hollow, and the resistance heating members are arranged at outer and inner peripheral surfaces of the core roller, respectively.

(2) The two or more resistance heating members are arranged at the outer peripheral surface of the core roller, and are layered together with an electrical insulating layer therebetween.

(3) The two or more resistance heating members are arranged at the inner peripheral surface of the core roller, and are layered together with an electrical insulating layer therebetween.

The above forms (1), (2) and (3) may be employed in combination for providing the two or more resistance heating members at the core roller.

The fixing device according to the invention may be provided with temperature detecting means provided for temperature control of the heating roller and arranged for a maximum heat portion (i.e., maximum heat generating portion) of each of the resistance heating members. The temperature detecting means may be a thermistor or a thermocouple. The fixing device, which is provided with the above temperature detecting means, may include current supply control means for controlling current supply to the resistance heating members independently of each other based on the temperatures detected by the temperature detecting means, respectively. The current supply control means can control the current supply such that the temperature detected by each temperature detecting means attains a predetermined temperature. All the predetermined temperatures may be equal to each other (e.g., equal to a fixing temperature required for heating and fixing an unfixed image to the record medium). Further, control of the current supply for attaining the fixing temperature may be performed on the resistance heating member, of which temperature is detected by the temperature detecting means arranged at the heating roller portion in contact with the record medium, and control of the current supply for attaining a predetermined temperature lower than the fixing temperature may be performed on the resistance heating member, of which temperature is detected by the temperature detecting means arranged at the heating roller portion not in contact with said record medium.

The heat distribution of each resistance heating member may be determined in the following manner (4) or (5).

(4) The heat distribution of each resistance heating member is determined such that, when all the resistance heating members are simultaneously powered and driven, a substantially uniform temperature distribution is achieved over an entire region on the heating roller over which the record medium passes.

(5) A portion in contact with the record medium of a small size and a portion not in contact with the record medium of the small size are defined at the heating roller, and the heat distributions are determined such that these portions can be heated independently of each other.

Each resistance heating member may be powered by such a form that a pair of current path units are arranged for each of the resistance heating members. Alternatively, a current path unit common to all the resistance heating members may be arranged at one end of the heating roller, and an independent current path unit for each of the resistance heating members may be arranged at the other end of the heating roller. This structure simplifies a wiring structure for the current path units compared with the structure in which each resistance heating member is provided with the independent current path unit pair.

A current may be supplied to each of the resistance heating members in the following manner (6), (7) or (8).

(6) The structure includes means for detecting a size of the record medium, and current supply control means for controlling the current supply to each resistance heating member of the heating roller based on the size of the record medium detected by the record medium size detecting means.

(7) The structure includes current supply control means for controlling current supply to the resistance heating members of the heating roller independently of each other, and the current supply control means is operable to supply a current to at least one of the resistance heating members for keeping a heat at the heating roller during standby in a fixing process.

(8) The structure includes current supply control means for driving independently the resistance heating members of the heating roller by repeating turn-on and turn-off. The current supply control means controls the current supply such that the two or more resistance heating members are not supplied with the currents at the same timing when the two or more resistance heating members are to be powered and driven. This form can reduce a power consumption, because the two or more resistance heating members are not simultaneously powered and thus an instantaneous large power is not required.

Two or more of the various forms of the fixing device described above may be employed in combination.

The image forming apparatus of the invention described above will be described below more in detail.

The fixing device in the image forming apparatus of the invention may selectively have the various forms described above.

The fixing device in the image forming apparatus may include the temperature detecting means, which is arranged for the maximum heat portion of each resistance heating member and is provided for temperature control of the heating roller. This structure may employ such a manner that image formation processing may be allowed after all the temperatures detected by the temperature detecting means attain predetermined temperatures, respectively. All the predetermined temperatures may be equal to each other (e.g., equal to the fixing temperature). The predetermined temperatures of all the resistance heating members may be equal to each other or different from each other based on the sizes of the record mediums.

Preferred examples of the fixing device and image forming apparatus of the invention will be described below with reference to the drawings.

Figure 2:
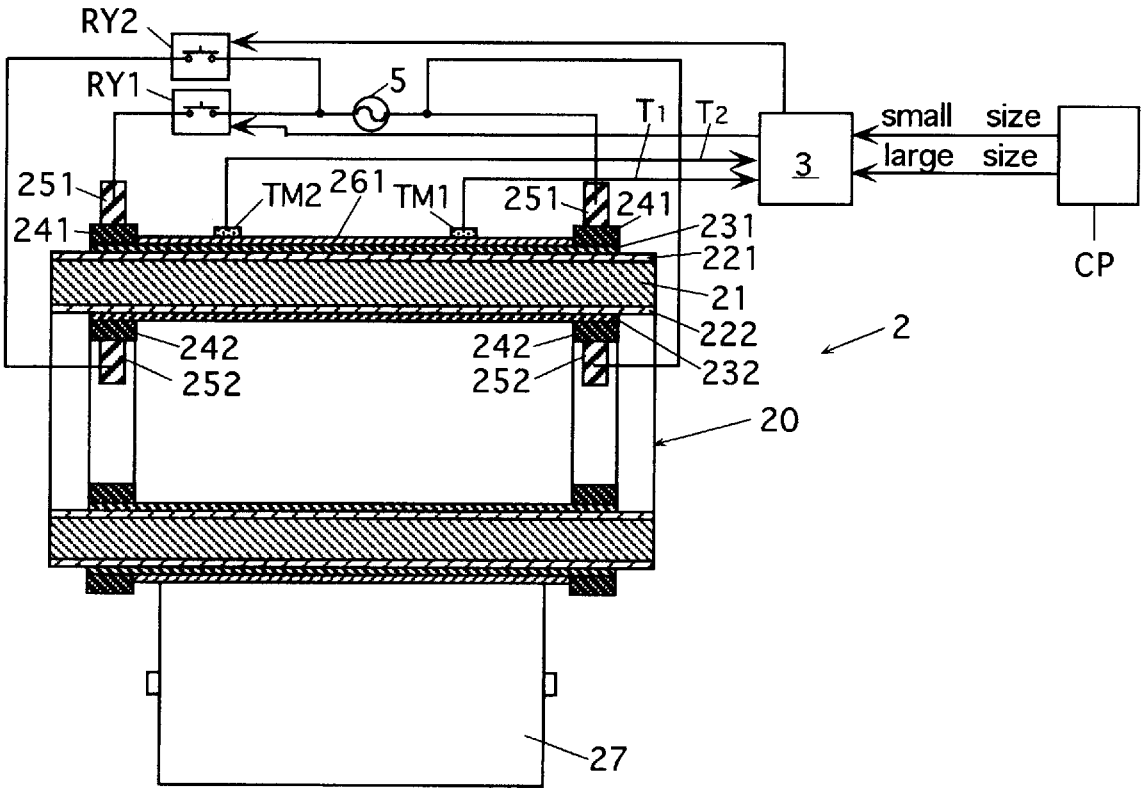
FIG. 2 schematically shows a section and an electrical connection form of an example of the fixing device of the invention provided at the printer shown in FIG. 1.

An example of the fixing device of the invention is shown in FIG. 2, and a printer provided with the fixing device according to the invention is shown in FIG. 1. This printer can effect image formation on record mediums of two kinds of, i.e., small and large sizes. FIG. 1 schematically shows a structure of the printer. FIG. 2 shows a schematic section and an electrical connection form of the fixing device.

This printer includes a photosensitive drum 1 which is driven to rotate in a direction indicated by an arrow in the figure by a motor M. Around the photosensitive drum 1, there are arranged a charger 11 for electrically and uniformly charging the surface of the photosensitive drum 1, a printer head 12 including laser exposing means for forming an electrostatic latent image on the surface of the photosensitive drum 1 by radiating laser beams in accordance with image information, a developing device 13 for developing the electrostatic latent image thus formed, a transfer charger 14, a separating charger 15, a cleaner 16 for cleaning residual toner, and a main eraser 17 for erasing residual charges.

The structure also includes record sheet transporting means (not shown), which can transport a record sheet to a position of the transfer charger 14 and can also transport the record sheet separated from the photosensitive drum 1 by the separating charger 15 to the fixing device 2.

The fixing device 2 has a heating roller 20 shown in FIG. 2 and a pressure roller 27 which is pressed against the heating roller 20 by pressing means (not shown). The heating roller 20 and the pressure roller 27 are rotatably carried by carrying means (not shown). The heating roller 20 is driven to rotate by the motor M. The pressure roller 27 is driven by the rotating heating roller 20 via the record sheet which is transported between these rollers.

The heating roller 20 includes a core roller 21 which has a hollow cylindrical form and is primarily made of aluminum. An electrical insulation layer 221 and a resistance heating member 231 in a layer form are formed in this order on the outer peripheral surface of the core roller 21. Current receiver members 241 each having a ring-like form and made of copper alloy are arranged around the outer peripheries of the opposite ends of the layered resistance heating member 231, which will be referred to as "resistance heating layer 231" hereinafter, respectively. A current supply member 251 made of carbon is arranged in contact with the outer peripheral surface of each current receiver member 241. Each current supply member 251 is pressed against the current receiver member 241 by pressing means (not shown), so that electrical connection can be ensured between their contact surfaces during integral rotation of the current receiver member 241 and the core roller 21. Similarly to the outer peripheral surface, an electrical insulation layer 222 and a resistance heating member 232 in a layer form are formed in this order on the inner peripheral surface of the core roller 21. Current receiver members 242 each having a ring-like form are arranged on the inner peripheries of the opposite ends of the resistance heating member 232, which will be referred to as "resistance heating layer 232" hereinafter. A current supply member 252 is arranged in contact with each current receiver member 242 and is pressed against the same by pressing means (not shown).

The current supply members 251 are connected to opposite ends or terminals of a power source 5 through a relay RY1. When a contact at the relay RY1 is closed, the power source 5 applies a voltage to the resistance heating layer 231, so that the heating roller 20 can be heated at the outer peripheral surface. The current supply members 252 are connected to the opposite terminals of the power source 5 through a relay RY2. When a contact at the relay RY2 is closed, the resistance heating layer 232 generates a heat, so that the heating roller 20 can be heated at the inner peripheral surface. The relays RY1 and RY2 are connected to a control unit 3 which controls an entire operation of the printer, so that the control unit 3 can control on/off of each of the contacts at the relays.

The resistance heating members provide different heat distributions (i.e., different generated heat distributions) in a direction of a rotation axis of the heating roller with respect to an entire sheet passage region including various sheet passage regions, over which record sheets of various sizes (small and large sizes in this example) between the maximum and minimum sizes pass for fixing, respectively. More specifically, the distributions are determined such that the surface portion of the heating roller at a region, which corresponds to the size of the record sheet for fixing processing, can be heated to the predetermined fixing temperature, and the surface portion of the heating roller at a residual region, if any, other than the above region can be maintained at a safe temperature.

Figure 5:
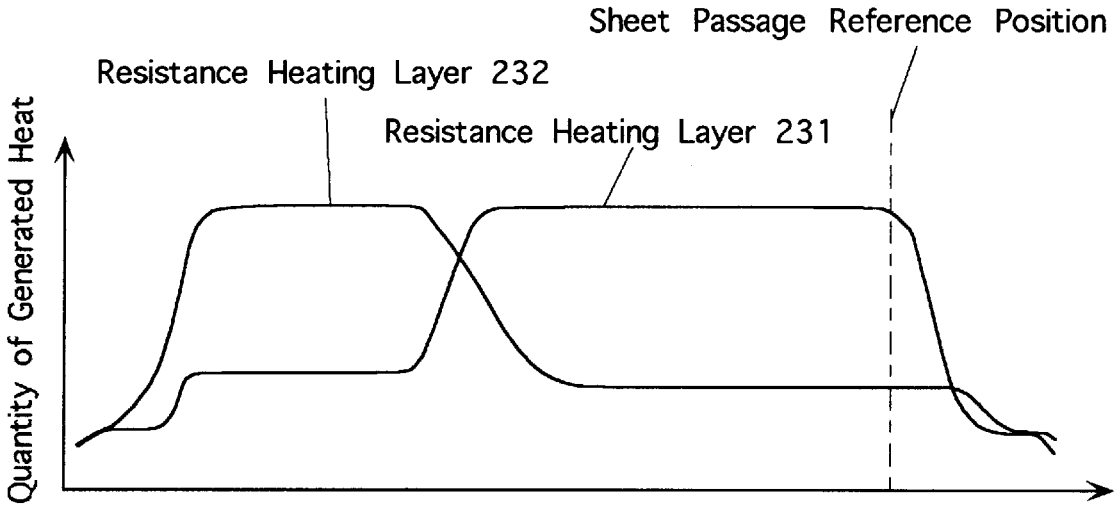
FIG. 5 shows an example of distributions of heat quantity (heat distributions) along a direction of a rotation axis of a heating roller at resistance heating layers which are arranged at the heating roller of the fixing device of the invention.

The resistance heating layers 231 and 232 generate different quantities of heats along the rotation axis of the heating roller 20, respectively, and, in this embodiment, provide the heat distributions (generated heat distributions) as shown in FIG. 5. In this fixing device, a reference position for passage of the record sheet is present at one side in the rotation axis direction of the heating roller 20. The resistance heating layer 231 heats a region over which the record sheet of a small size passes. The resistance heating layer 232 heats the residual region. Therefore, the whole heat distribution can be substantially uniform over the entire region (i.e., the region for passage of the large record sheet in this embodiment) of the heating roller, when a voltage is applied simultaneously to both the resistance heating layers 231 and 232.

Figure 6:
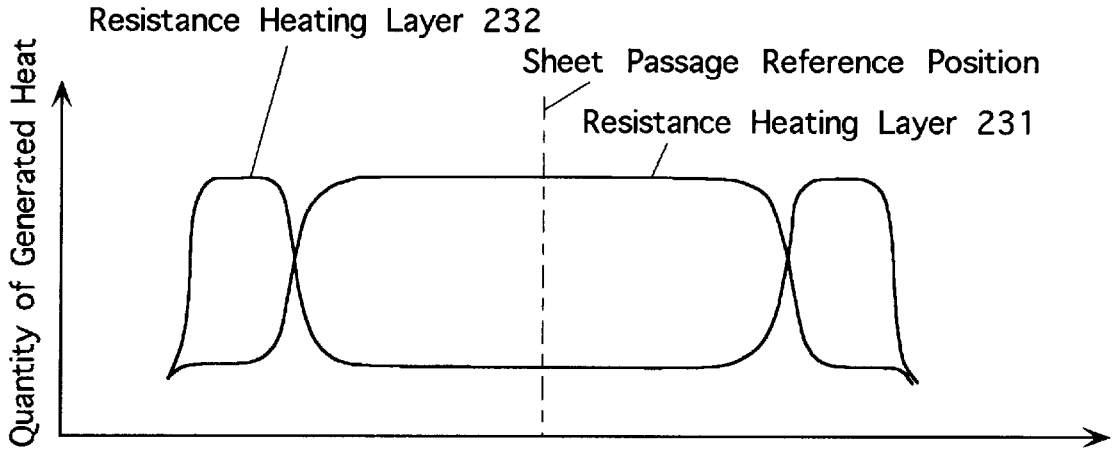
FIG. 6 shows another example of distributions of heat quantity (heat distributions) along a direction of a rotation axis of a heating roller at resistance heating layers which are arranged at the heating roller of the fixing device of the invention.

The heat distribution along the rotation axis direction of the heating roller at each resistance heating layer is not restricted to this example, in which the sheet passage reference position is present at one side in the rotation axis direction of the heating roller. For example, as shown in FIG. 6, the sheet passage reference position may be present at the center in the rotation axis direction of the heating roller, whereby different heat distributions (generated heat distributions) may be achieved.

A separator layer 261, which is made of polytetrafluoroethylene (PTFE), is formed around the resistance heating layer 231 arranged at the outer periphery of the heating roller 20. The separator layer 261 is provided for promoting separation of the heated toner image from the heating roller 20 when the record sheet travels between the heating roller 20 and the pressure roller 27.

Thermistors TM1 and TM2, i.e., temperature detecting means are arranged in contact with the outer peripheral surface of the separator layer 261, and are located at positions corresponding to the maximum heat portions (maximum heat generated portions) of the resistance heating layers 231 and 232 along the rotation axis direction of the heating roller 20. The thermistors TM1 and TM2 can detect the surface temperatures of the heating roller 20 at these positions, respectively. Based on the temperatures detected by the thermistors TM1 and TM2, the resistance heating layers 231 and 232 are powered and driven independently of each other for controlling the temperatures.

The control unit 3 for controlling the entire operation of the printer includes a central processing unit (CPU), and receives the surface temperatures at the above two portions of the heating roller 20 from the thermistors TM1 and TM2. It also receives sizes (small and large sizes in this example) of the record sheet from a computer CP, a word processor or the like connected to this printer, and utilizes them for control of the temperature of the heating roller 20 and others. The sizes of the record sheets may be entered through a control panel or the like provided at this printer.

Figure 3:
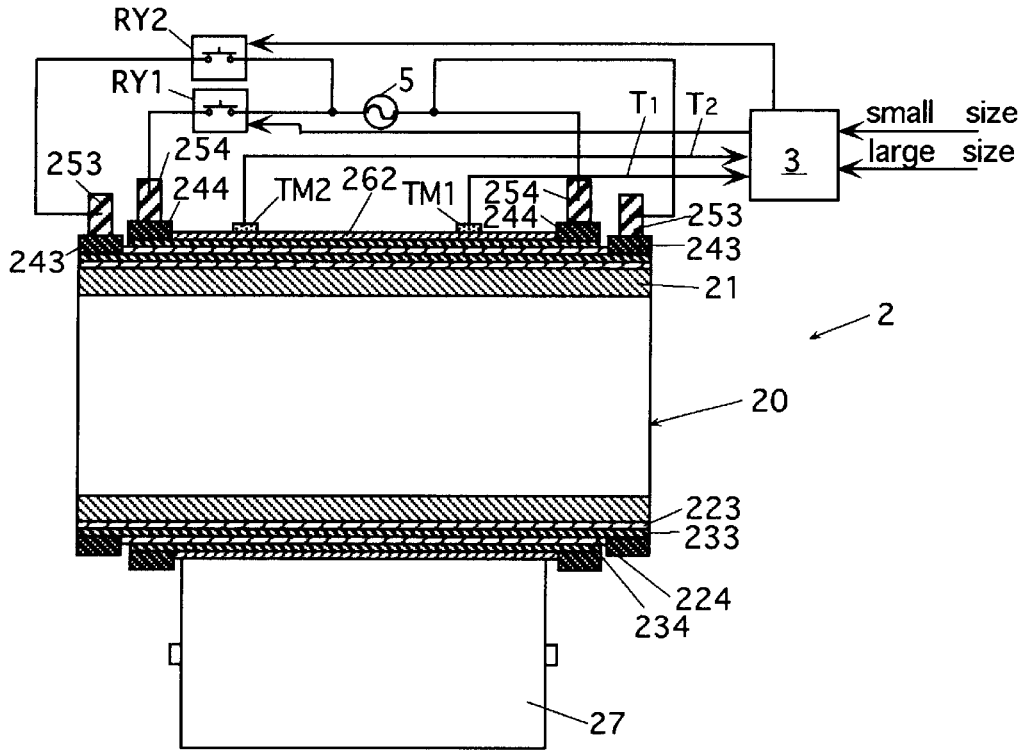
FIG. 3 schematically shows a section and an electrical connection form of another example of the fixing device of the invention.

The structure including the two resistance heating layers arranged at the core roller 21 is not restricted to the foregoing, in which the resistance heating layer is arranged at each of the outer and inner peripheral surfaces of the core roller 21, as is done in the above example. For example, as shown in FIG. 3, resistance heating layers may be layered over the outer peripheral surface of the core roller 21 with an electrical insulation layer therebetween. The fixing device shown in FIG. 3 is substantially the same as that shown in FIG. 2 except for the structure of the heating roller 20. FIG. 3 shows a schematic section and an electrical connection form of the fixing device. Parts and portions having the substantially same structures and/or performing the substantially same operations as those in FIG. 2 bear the same reference symbols.

In the fixing device shown in FIG. 3, an electrical insulation layer 223, a resistance heating layer 233, an electrical insulation layer 224, a resistance heating layer 234 and a separator layer 262 are formed in this order on the outer peripheral surface of the core roller 21. A voltage can be applied to the resistance heating layers 233 and 234 through ring-shaped current receiver members 243 and 244, which are arranged at the opposite ends of the outer peripheral surfaces thereof, respectively, and current supply members 253 and 254, which are in contact with these current receiver members, respectively. A single resistance heating layer or multiple resistance heating layers, between which an electrical insulation layer is interposed, may be arranged at the inner peripheral surface of the core roller similarly to the fixing device shown in FIG. 2.

Figure 4:
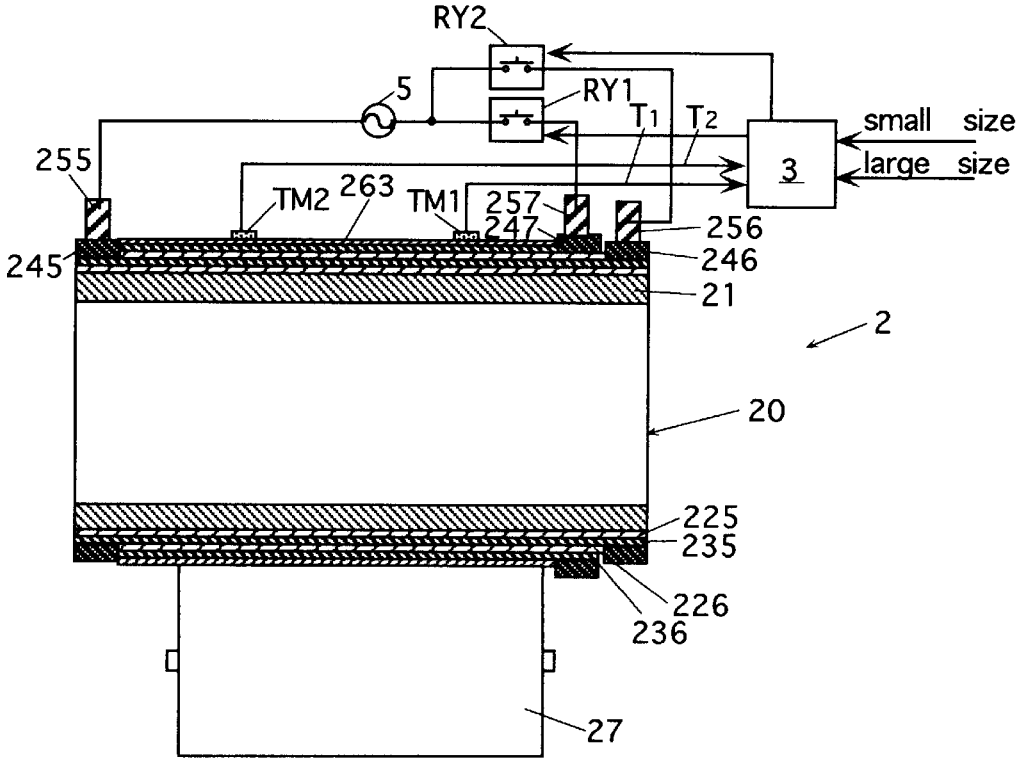
FIG. 4 schematically shows a section and an electrical connection form of still another example of the fixing device of the invention.

As exemplified in FIG. 4, the resistance heating layers may commonly employ a single current path unit, which is formed of a current supply member and a current receiver member and is arranged at one end of the heating roller 20. The fixing device shown in FIG. 4 includes two resistance heating layers which are arranged on the outer peripheral surface of the core roller 21 and are layered together with an electrical insulation layer therebetween. FIG. 4 shows a schematic section and an electrical connection form of the fixing device. Parts and portions having the substantially same structures and/or performing the substantially same operations as those in FIG. 2 bear the same reference symbols.

In the fixing device shown in FIG. 4, an electrical insulation layer 225, a resistance heating layer 235, an electrical insulation layer 226, a resistance heating layer 236 and a separator layer 263 are arranged in this order on the outer peripheral surface of the core roller 21. At one end (left end in FIG. 4) of the heating roller 20, there is arranged a current receiver member 245, which is electrically connected to the resistance heating layers 235 and 236. A current supply member 255 is in contact with the current receiver member 245. At the other end (right end in FIG. 4) of the heating roller 20, there is arranged current receiver members 246 and 247 which are electrically connected to the resistance heating layers 235 and 236, respectively. Current supply members 256 and 257 are in contact with the current receiver members 246 and 247, respectively.

The current supply member 255 is connected to one of the terminals of the power source 5. The current supply members 256 and 257 are connected to the other terminal of the power source 5 through the relays RY2 and RY1, respectively. Owing to the above structure, a current can be supplied to the resistance heating layers 235 and 236 through the common current path unit (current supply member 255 and current receiver member 245) arranged at one end of the heating roller 20. Owing to provision of the common current path unit, it is possible to reduce the number of parts and the cost. Provision of the common current path is particularly effective in reduction of the cost in the case where multiple resistance heating layers are arranged at the core roller.

Figure 7:
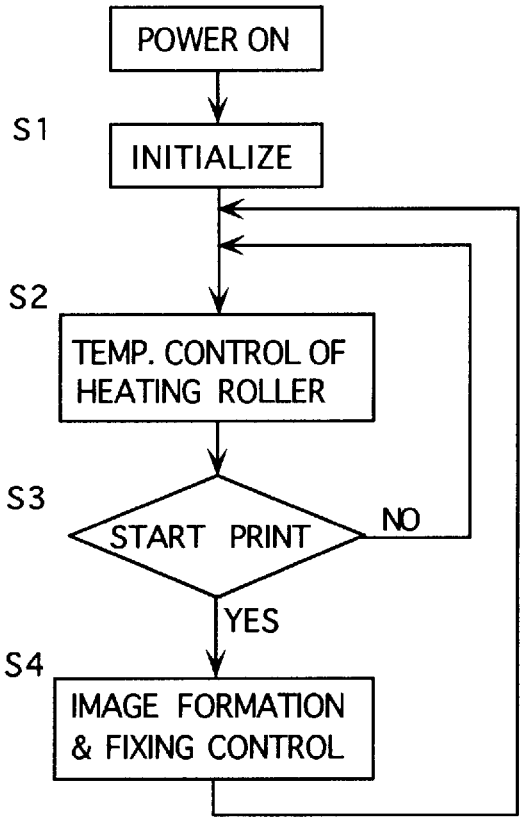
FIG. 7 is a flow chart showing an example of an operation of a control unit of a printer according to the invention.
Figure 8:
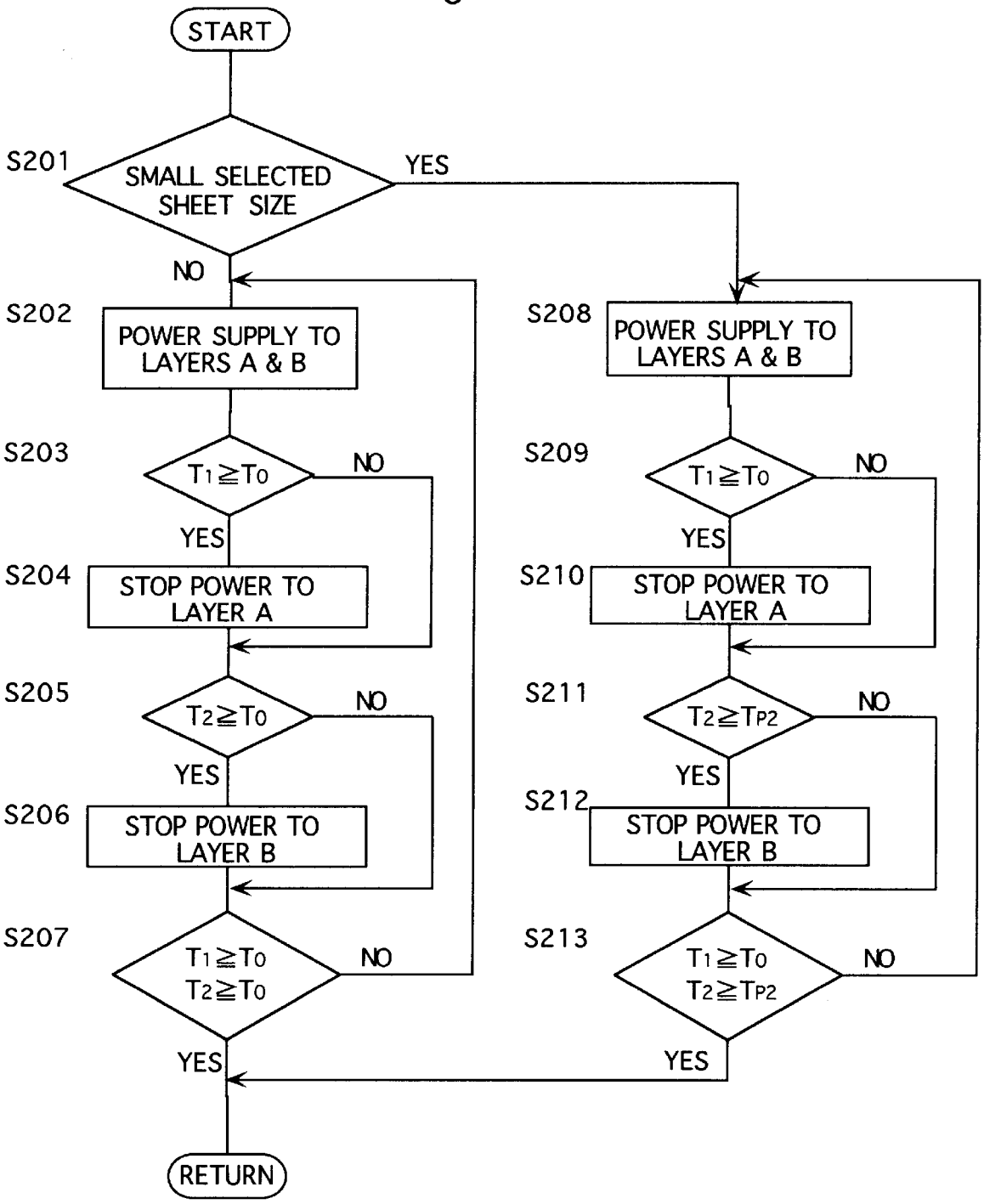
FIG. 8 is a flowchart showing an example of a method of controlling a temperature of the fixing device of the invention.

An operation of the printer shown in FIG. 1 including the fixing device shown in FIG. 2 will be described below with reference to flow charts of FIGS. 7 and 8 showing an operation of the control unit 3. FIG. 7 is a flow chart showing a main routine of the operation of the control unit 3.

Upon power-on of the printer, the CPU and others are initialized (step Si in FIG. 7). The temperature of the heating roller 20 is controlled (step S2 in FIG. 7). The temperature control at step S2 in FIG. 7 will be described later more in detail. In the state where the heating roller 20 is controlled at a predetermined temperature, an instruction of print start is sent from the computer CP, word processor or the like connected to the printer. Thereby, the photosensitive drum 1 and its peripheral equipments perform the image formation, and the fixing device 2 performs heating and fixing of the toner image onto the record sheet (steps S3 and S4 in FIG. 7).

The image formation is performed as follows under the control of the control unit 3. The charger 11 charges the surface of the rotating photosensitive drum 1, and the printer head 12 radiates to the charged region the laser beams based on the image information sent from the computer CP, word processor or the like connected to this printer. Thereby, an electrostatic latent image is formed. A developing device 13 develops the electrostatic latent image to form a toner image. The toner image is transferred by the transfer charger 14 onto the record sheet, which is transported by transporting means (not shown). The record sheet bearing the toner image is separated from the photosensitive drum 1 by the separator charger 15, and is transported to the fixing device 2. In the fixing device 2, the record sheet bearing the toner image is transported between the heating roller 20, which is heated to a predetermined fixing temperature, and the pressure roller 27, which is pressed against the heating roller 20. During this, the toner image is fixed onto the record sheet by the heat and pressure. Transporting means (not shown) discharges the record sheet from the printer.

The cleaner 16 removes residual toner which was not transferred onto the record sheet at the transfer position and remains on the surface of the photosensitive drum 1. Further, a main eraser 17 erases residual charges on the surface of the photosensitive drum 1 for the next image forming process.

The temperature control of the heating roller 20 (step S2 in FIG. 7) is performed as shown in the flow chart of FIG. 8 based on the selected sheet sizes (small and large sizes in this example) sent to the control unit 3. In FIG. 8, resistance heating layers A and B represent the resistance heating layers 231 and 232, respectively.

When the selected sheet size, which is sent from the computer, word processor or the like connected to the printer, is large, the control unit 3 closes the contacts at the relays RY1 and RY2, so that the power source 5 applies a voltage to both the resistance heating layers 231 and 232, and thereby the heating roller 20 is heated (steps S201 and S202 in FIG. 8).

When a temperature $T_1$ detected by the thermistor TM1, which is arranged at the position corresponding to the maximum heat portion of the resistance heating layer 231, reaches or exceeds a predetermined fixing temperature $T_0$ (180° C. in this example), current supply to the resistance heating layer 231 stops (steps S203 and S204 in FIG. 8). Likewise, when a temperature $T_2$ detected by the thermistor TM2, which is arranged at the position corresponding to the maximum heat portion of the resistance heating layer 232, reaches or exceeds the predetermined fixing temperature $T_0$, current supply to the resistance heating layer 232 stops (steps S205 and S206 in FIG. 8). Current supply to the resistance heating layers 231 and 232 continues until the detected temperatures $T_1$ and $T_2$ reach or exceed the predetermined fixing temperature $T_0$, respectively (steps S202–S207 in FIG. 8).

When the selected sheet size is small, a current is supplied to the resistance heating layers 231 and 232 (steps S201 and S208 in FIG. 8). When the temperature $T_1$ detected by the thermistor TM1 detecting the temperature at a region, over which a record sheet of a small size travels, reaches or exceeds the predetermined fixing temperature $T_0$ (180° C. in this example), current supply to the resistance heating layer 231 stops (steps S209 and S210 in FIG. 8). In the process of handling the small record sheet, the thermistor TM2 detects the temperature at the residual region (i.e., sheet non-passage region). When the temperature $T_2$ thus detected by the thermistor TM2 reaches or exceeds a predetermined temperature $T_{P2}$ (120° C. in this example), current supply to the resistance heating layer 232 stops (steps S211 and S212 in FIG. 8). Current supply to the resistance heating layers 231 and 232 continues as follows. The current is supplied to the resistance heating layer 231, which heats the region for passage of the small sheet, until the detected temperature $T_1$ reaches or exceeds the predetermined fixing temperature $T_0$. Also, the current is supplied to the resistance heating layer 232, which heats the remaining region, until the detected temperature $T_2$ reaches or exceeds the predetermined temperature $T_{P2}$ (steps S208–S213 in FIG. 8).

Figure 9:
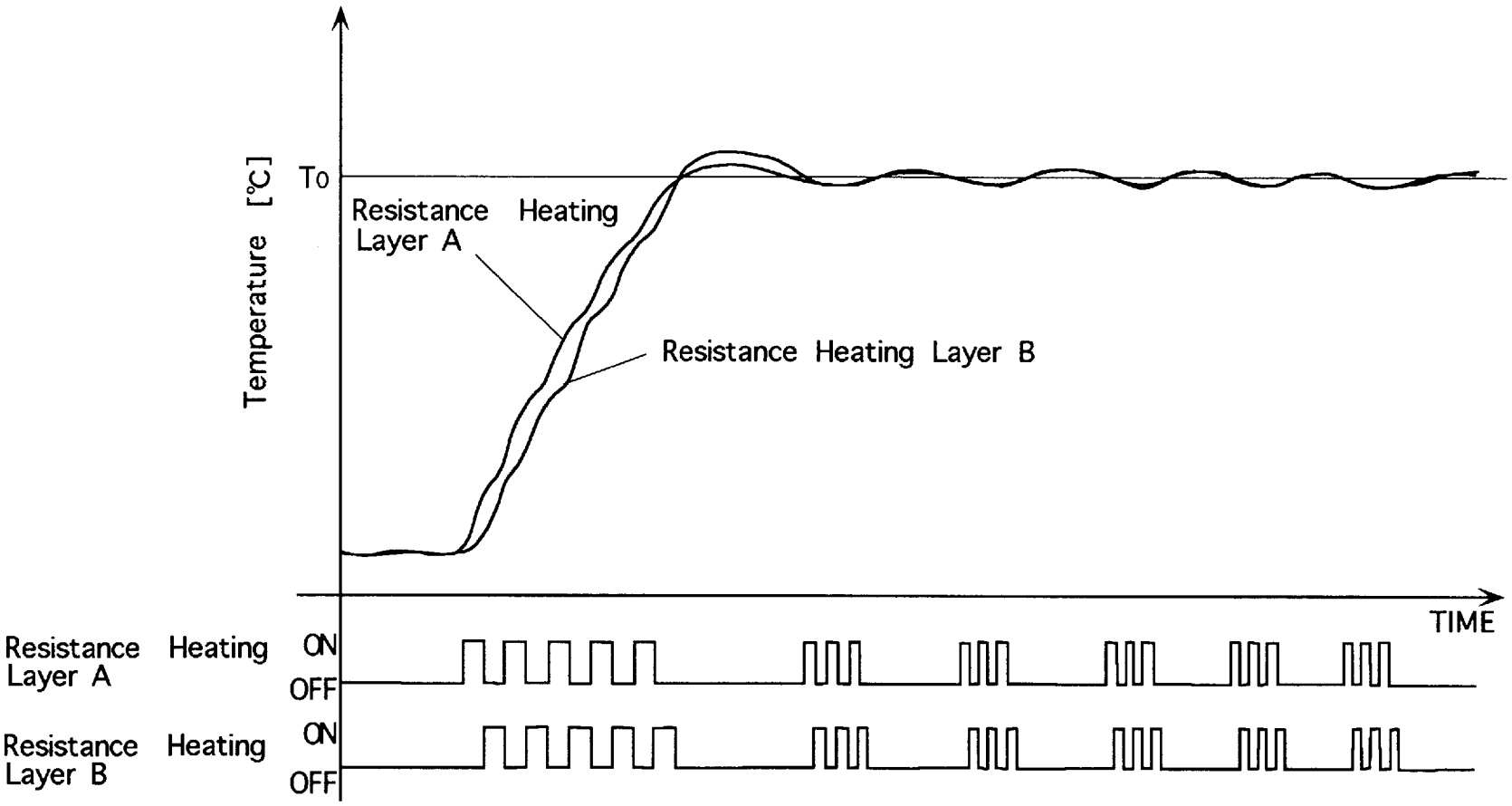
FIG. 9 shows an example of timings of current supply to the resistance heating layers arranged at the heating roller of the fixing device of the invention as well as an example of temperature rising at the resistance heating layers.

When the current is supplied to both the resistance heating layers 231 and 232 (steps S202 and S208 in FIG. 8), the current supply timings may be shifted from each other so that the current supply timings determined by on/off of power to the respective resistance heating layers may not overlap each other, as shown in FIG. 9. FIG. 9 exemplifies timings of current supply to the resistance heating layers 231 and 232 and rising of temperatures of the resistance heating layers. In FIG. 9, resistance heating layers A and B represent the resistance heating layers 231 and 232, respectively.

The sheet passage region corresponding to the selected sheet size is heated to the predetermined fixing temperature $T_0$, and the heating roller 20 kept at the fixing temperature $T_0$ performs the heating and fixing of the toner image onto the record sheet, when the print start instruction is issued as described above (steps S3 and S4 in FIG. 7).

According to the fixing device described above, current supply to the resistance heating layers 231 and 232, which provide different heat distributions (generated heat distributions) along the rotation axis direction of the heating roller, is controlled independently of each other based on the detected temperatures $T_1$ and $T_2$ of the heating layers and the selected sheet size, respectively.

When the selected sheet size is small, the resistance heating layer 231 heating the passage region for the small sheet can keep this small sheet passage region of the heating roller 20 at the predetermined fixing temperature $T_0$ (180° C. in this example) based on the detected temperature $T_1$ of the thermistor TM1. Therefore, no problem arises in the heating and fixing. During this operation, the resistance heating layer 232 heating the sheet non-passage region is powered and controlled to keep the predetermined temperature $T_{P2}$ (120° C. in this example) independently of the resistance heating layer 231, so that the temperature at the sheet non-passage region does not abnormally rise. Therefore, respective portions in the heating roller 20 are kept at appropriate temperatures without causing abnormal temperature rising. Thereby, it is possible to suppress sufficiently thermal damages of the heating roller 20, its peripheral parts and the record sheet as well as offset of the toner image. Thus, a fixed image of a good quality can be obtained safely and stably.

When the selected sheet size changes from the small size to the large size, the region which was the sheet non-passage region for the small sheet is already maintained at the predetermined temperature $T_{P2}$ (120° C. in this example) by the resistance heating layer 232 powered under control. Therefore, the temperature of this region can be rapidly raised to the predetermined fixing temperature $T_0$ (180° C. in this example). The temperature of the region, which was the sheet non-passage region when the selected sheet size is small, is controlled by the current supply to the resistance heating layer 232 independent of the resistance heating layer 231. Therefore, such a problem does not arise that a long time is required for heating this region to the predetermined fixing temperature $T_0$.

When the selected sheet size is large, the resistance heating layers 231 and 232 heating the region of the heating roller 20 forming the sheet passage region are controlled to keep the predetermined fixing temperature $T_0$ based on the temperatures $T_1$ and $T_2$ detected by the thermistors TM1 and TM2, respectively, so that no problem arises in the heating and fixing. In this case, the sheet non-passage region is not present at the heating roller 20, so that the respective portions of the heating roller 20 are kept at appropriate temperatures without abnormal temperature rising. Thereby, it is possible to suppress sufficiently thermal damages of the heating roller 20, its peripheral parts and the record sheet as well as offset of the toner image. Thus, a fixed image of a good quality can be obtained safely and stably.

Whichever the selected sheet size may be, the heating roller 20 is heated by the heat source formed of the resistance heating layers 232 and 231 which are arranged at the inner and outer peripheries of the core roller 21, respectively. Therefore, the temperature of the region of the heating roller 20 forming the sheet passage region can be rapidly heated.

Therefore, the printer equipped with the fixing device described above can perform safely and stably the image formation.

Figure 10:
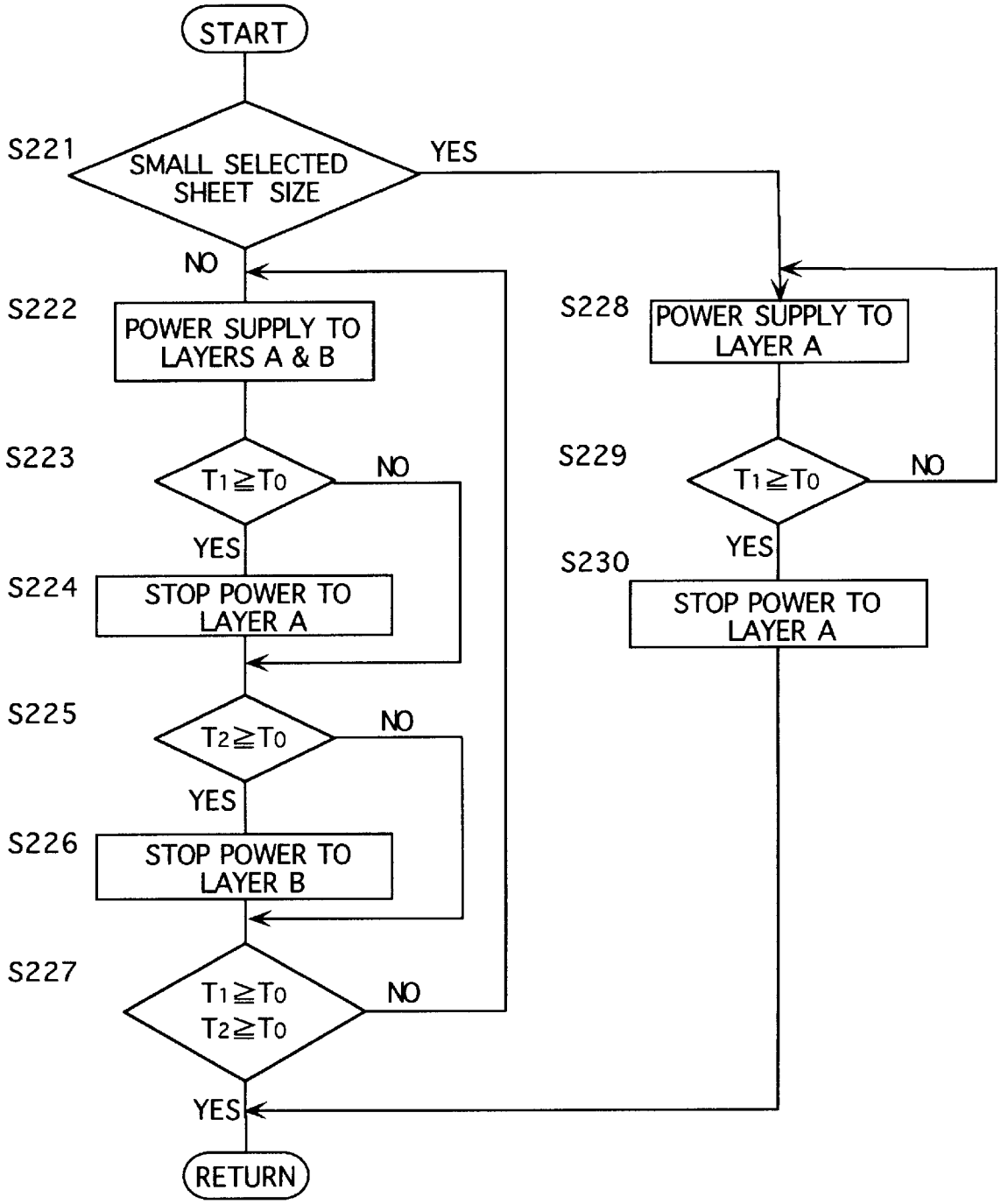
FIG. 10 is a flowchart showing another example of temperature control of the fixing device of the invention.

The temperature control of the heating roller (step S2 in FIG. 7) may be performed in accordance with a flow chart of FIG. 10. In this example, when the selected sheet size is large, current supply to the resistance heating layers 231 and 232 is controlled independently of each other based on the temperatures $T_1$ and $T_2$ detected by the thermistors TM1 and TM2 similarly to the steps S201–S207 in FIG. 8. Thereby, the sheet passage region of the heating roller 20 is kept at the predetermined fixing temperature $T_0$ (steps S221–S227 in FIG. 10).

When the selected sheet size is small, the current is supplied only to the resistance heating layer 231 (steps S221 and S228 in FIG. 10), so that the current supply to the resistance heating layer 231 continues until the detected temperature $T_1$ of the thermistor TM1, which detects the temperature of the sheet passage region for the small sheet, reaches or exceeds the predetermined fixing temperature $T_0$. When the detected temperature $T_1$ reaches or exceeds the fixing temperature $T_0$, the current supply to the resistance heating layer 231 stops (steps S229 and S230 in FIG. 10).

In the fixing device performing the temperature control as described above, the current supply to the resistance heating layers 231 and 232, which provide different heat distributions (generated heat distributions) along the rotation axis of the heating roller 20, is performed independently of each other based on the temperatures $T_1$ and $T_2$ detected by the thermistors TM1 and TM2, respectively. Therefore, the sheet passage region is kept at the predetermined fixing temperature $T_0$, and the sheet non-passage region is kept at the safe temperature $T_0$ or safe temperature not higher than the fixing temperature $T_0$. Accordingly, the fixing device of which temperature is controlled in this manner can prevent abnormal rising of the temperatures at the respective portions of the heating roller 20. Thereby, it is possible to suppress sufficiently thermal damages of the heating roller 20, its peripheral parts and the record sheet as well as offset of the toner image. Thus, a fixed image of a good quality can be obtained safely and stably.

Figure 11:
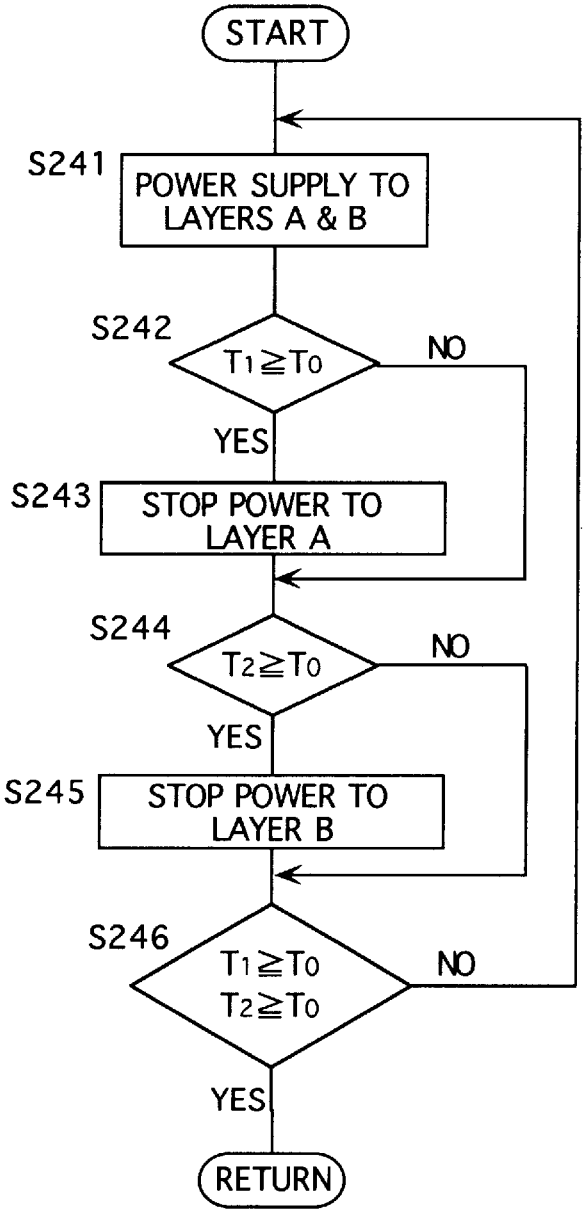
FIG. 11 is a flowchart showing still another example of temperature control of the fixing device of the invention.

The temperature control of the heating roller (step S2 in FIG. 7) may be performed in accordance with a flow chart shown in FIG. 11 instead of the flow charts shown in FIGS. 8 and 10. In this example, the temperature of the heating roller 20 is controlled regardless of the selected sheet size.

In this case, the current is first supplied to the resistance heating layers 231 and 232 (step S241 in FIG. 11). When the temperature $T_1$ detected by the thermistor TM1, which is arranged at the position corresponding to the maximum heat portion of the resistance heating layer 231, reaches or exceeds the predetermined fixing temperature $T_0$, the current supply to the resistance heating layer 231 stops (steps 242 and 243 in FIG. 11). When the temperature $T_2$ detected by the thermistor TM2, which is arranged at the position corresponding to the maximum heat portion of the resistance heating layer 232, reaches or exceeds the predetermined fixing temperature $T_0$, the current supply to the resistance heating layer 232 stops (steps 244 and 245 in FIG. 11). The current supply to the resistance heating layers 231 and 232 continues until the detected temperatures $T_1$ and $T_2$ reach or exceed the predetermined temperature $T_0$, respectively (steps S241–S246 in FIG. 11).

In this manner, the heating roller 20 is kept at the predetermined fixing temperature $T_0$, and will perform the heating and fixing upon receipt of the print start instruction as described above (steps S2 and S4 in FIG. 7).

This temperature control of the fixing device can achieve a similar effect. More specifically, even when the selected sheet size is small, the temperatures of the sheet passage region and the sheet non-passage region are detected by the thermistors TM1 and TM2 independently of each other, respectively, and the current supply to the resistance heating layers 231 and 232 is controlled independently of each other based on the detected temperatures $T_1$ and $T_2$, respectively, so that abnormal rising of the temperature at the sheet non-passage region of the heating roller 20 can be prevented. Accordingly, the temperatures at the respective portions of the heating roller 20 do not abnormally rise, and can be kept at appropriate temperatures. Thereby, it is possible to suppress sufficiently thermal damages of the heating roller 20, its peripheral parts and the record sheet as well as offset of the toner image. Thus, a fixed image of a good quality can be obtained safely and stably. Further, the above temperature control of the heating roller always keeps the sheet passage region at the predetermined fixing temperature regardless of the selected sheet size. Therefore, compared with the case where the temperature control is performed in accordance with the flow charts of FIGS. 8 and 10, the heating and fixing can be performed rapidly when the selected sheet size changes from the small size to the large size.

The temperature control of the flow charts shown in FIGS. 7, 8, 10 and 11 can be applied not only to the fixing device shown in FIG. 2 but also to other fixing devices, for example, shown in FIGS. 3 and 4.

The fixing devices have been described in connection with the structure, in which the fixing device handles only two kinds of (i.e., small and large) sheets, and only two resistance heating layers providing different heat distributions along the rotation axis of the heating roller are arranged at the core roller. However, the number of the resistance heating layers is not restricted to two. The number of resistance heating layers may be selected in accordance with the kinds of sizes of the record sheets, and the structure may employ a combination of the structure in FIG. 2, in which the single resistance heating layer is arranged at each of the inner and outer peripheries of the core roller, and the structure in FIG. 3, in which the two resistance heating layers are layered on the outer peripheral surface of the core roller with the electrical insulation layer therebetween. This structure can provide different heat distributions (generated heat distributions) along the rotation axis of the heating roller owing to the resistance heating layers, so that a fixed image of a good quality can be obtained safely and stably.

In the embodiments described above, the temperature of the heating roller is controlled in accordance with the size of the record sheet supplied to the fixing device. However, the temperature may be controlled in accordance with the number of printed sheets and/or a set mode such as doubleside copy.

The embodiments of the invention have been described in connection with the fixing device arranged in the printer. However, the fixing device of the invention can be arranged in an image forming apparatus such as a copying machine or a facsimile other than the printer, in which case image formation can likewise be performed safely and stably.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fixing device for heating and fixing an unfixed image to a record medium, said fixing device comprising:

a heating roller provided with a core roller and at least two resistance heating layers arranged on said core roller and controlled to be electrically powered independently of each other, said core roller being rotatable around a rotation axis, said core roller having a width in a direction parallel to the rotation axis, each of said resistance heating layers having a width substantially the same as the width of said core roller in said direction, wherein said resistance heat layers provide different heat distribution in the direction.

2. The fixing device according to claim 1, wherein two or more of said resistance hearing layers are arranged at an outer peripheral surface of said core roller, and are layered together with an electrical insulating layer therebetween.

3. The fixing device according to claim 1, wherein two or more of said resistance heating layers are arranged at an inner peripheral surface of said core roller, and are layered together with an electrical insulating layer therebetween.

4. The fixing device according to claim 1, further comprising, temperature detecting means provided for temperature control of said heating roller and arranged for a maximum heat portion of each of said resistance heating layers.

5. The fixing device according to claim 4, further comprising, current supply control means for controlling current supply to said resistance heating layers independently of each other based on the temperatures detected by said temperature detecting means, respectively, said current supply control means being operable to control the current supply such that the temperature detected by each of said temperature detecting means attains a predetermined temperature.

6. The fixing device according to claim 5, wherein all of said predetermined temperatures are equal to a fixing temperature.

7. The fixing device according to claim 5, wherein control of the current supply for attaining a fixing temperature is performed on said resistance heating layer, of which temperature is detected by said temperature detecting means arranged at a portion of said heating roller contact with said recording medium, and wherein control of the current supply for attaining a predetermined temperature lower than the fixing temperature is performed on said resistance heating layer, of which temperature is detected by said temperature detecting means arranged at a portion of said heating roller not in contact with said recording medium.

8. The fixing device according to claim 1, wherein the heating distribution of each of said resistance heating layers is determined such that, when all of said resistance heating layers are simultaneously powered and driven, a substantially uniform temperature distribution is achieved over an entire regions on said heating roller over which the recording medium passes.

9. The fixing device according to claim 1, wherein a portion of said heating roller in contact with the recording medium of small size and a portion of said heating roller not in contact with said recording medium or small size are defined at said heating roller, and said heat distributions are determined such that portions can be heated independently of each other.

10. The fixing device according to claim 1, further comprising:

record medium size detecting means for detecting a size of said record medium, and current supply control means for controlling the current supply to each of said resistance heating layers of said heating roller based on the size of the recording medium detected by said recording medium size detecting means.

11. The fixing device according to claim 1, further comprising, current supply control means for controlling current supply to said resistance heating layers of said heating roller independently of each other, wherein said current supply control means is operable to supply a current to at least one of said resistance heating layers for keeping a heat at said heating roller during standby in a fixing process.

12. In a fixing device having a heat roller for heating and fixing an unfixed image to a record medium, said heat roller comprising:

a core roller; and at least two resistance heating members arranged at said core roller and controlled to be electrically powered independently of each other, wherein said resistance heating members provide different heat distribution in a direction of a rotation axis of said heating roller, and wherein said core roller is hollow, and said resistance heating members are arranged at outer and inner peripheral surface of said core roller, respectively.

13. In a fixing device having a heat roller for heating and fixing an unfixed image to a record medium, said heat roller comprising:

a core roller; and at least two resistance heating members arranged at said core roller and controlled to be electrically powered independently of each other, wherein said resistance heating members provide different heat distribution in a direction of a rotation axis of said heating roller, and wherein a current path unit common to all of said resistance heating members is arranged at one end of said heating roller, and an independent current path unit for each of resistance heating members is arranged at the other end of said heating roller.

14. A fixing device for heating and fixing an unfixed image to a record medium, said fixing device comprising:

a heating roller provided with a core roller and at least two resistance heating members arranged at said core roller and controlled to be electrically powered independently of each other, said resistance heating members providing different heat distribution in a direction of a rotation axis of said heating roller; and current supply control means for driving independently said resistance heating members of said heating roller by repeating turn-on and turn-off, wherein said current supply control means controls the current supply such that the two or more resistance heating members are not supplied with the currents at the same timing when said two or more resistance heating members are to be powered and driven.

15. An image forming apparatus comprising:

a fixing device for heating and fixing an unfixed image to a recording medium, said fixing device including a heat roller provided with a core roller and at least two resistance heating layers arranged at said core roller and controlled to be electrically powered independently of each other, said core roller being rotatable provided around a rotation axis, said core roller having a width in a direction parallel to the rotation axis, each of said resistance heating layers having a width substantially same as the width of said core roller in said direction, wherein said resistance heating layers provide different heat distributions in the direction.

16. The image forming apparatus according to claim 15, wherein said fixing device further comprises temperature detecting means provided for temperature control of said heating roller and arranged for a maximum heat portion of each of said resistance heating layers.

17. The image forming apparatus according to claim 16, wherein image formation processing is allowed after all the temperatures detected by said temperature detecting means attain predetermined temperatures, respectively.

18. The image forming apparatus according to claim 17, wherein all of said predetermined temperatures are equal to each other.

19. The image forming apparatus according to claim 17, wherein said predetermined temperatures of all of said resistance heating layers are equal to each other or different from each other based on the sizes of the recording mediums.

20. The image forming apparatus according to claim 15 further comprising:

record medium size detecting means for detecting a size of said recording medium transported to said fixing device, and current supply control means for controlling the current supply to each of said resistance heating layers of said heating roller in said fixing device based on the size of the recording medium detected by said record medium size detecting means.

21. The image forming apparatus according to claim 15, further comprising, current supply control means for controlling current supply to said resistance heating layers of said heating roller in said fixing device independently of each other, wherein said current supply control means is operable to supply a current to at least one of said resistance heating layers for keeping a heat at said heating roller during standby in a fixing process.

22. An image forming apparatus including a fixing device for heating and fixing an unfixed image to a recording medium, said fixing device comprising:

a core roller at least two resistance heating members arranged at said core roller and controlled to be electrically powered independently of each other, wherein said resistance heating members provide different heat distributions in a direction of a rotation axis of said heating roller;

a common current path unit arranged at one end of said heating roller in said fixing device, said current path unit being common to all of said resistance heating members; and an independent current path unit arranged at the other end of said heating rollers, said independent current path being independent for each of said resistance heating members.

23. An image forming apparatus comprising:

a fixing device for heating and fixing an unfixed image to a recording medium, said fixing device including a heating roller provided with a core roller and at least two resistance heating members arranged at said core roller and controlled to be electrically powered independently of each other, wherein said resistance heating members provide different heat distributions in a direction of a rotation axis of said heating roller; and current supply control means for driving independently said resistance heating members of said heating roller in said fixing device by repeating turn-on and turn-off, wherein said current supply control means controls the current supply such that the two or more resistance heating member are not supplied with the currents at the same timing when said two or more resistance heating members are to be powered and driven.

24. In a fixing device having a heating roller for heating and fixing an unfixed image to a record medium, said heating roller comprising:

a core roller which has a width in a direction parallel to a rotation axis thereof;

a first resistance heat layer provided on said core roller, said first resistance heat layer having a width substantially same as the width of said core roller in said direction, said first resistance heat roller providing a first heat distribution in the direction when an electrical power is applied thereto; and a second resistance heat layer insulatively provided on said core roller with said first resistance heat layer, said second resistance heat layer having a width substantially same as the width of said core roller in said direction, said resistance heat layer providing a second heat distribution in the direction when an electrical power is applied thereto, the second heat distribution being different from the first heat distribution.

25. The heating roller according to claim 24, further comprising:

a common electrode provided at one end of said core roller, said common electrode being connected with one ends of said first and second resistance heat layers;

a first individual electrode provided at the other end of said core roller, said first individual electrode being connected with the other end of said first resistance heat layer; and a second individual electrode provided at the other end of said core roller, said second individual electrode being connected with the other end of said second resistance heat layer.

* * * * *

UNITED STATES PATENT AND TRADEMARK OFFICE

CERTIFICATE OF CORRECTION

PATENT NO. : 5,822,670
DATED : October 13, 1998
INVENTOR(S) : Yuusuke MORIGAMI

It is certified that error appears in the above-identified patent and that said Letters Patent is hereby corrected as shown below:

Title page, insert the following:
--[30] Foreign Application Priority Data
Jan. 16, 1996 [JP] Japan.....8-4791--

Signed and Sealed this

Sixteenth Day of March, 1999

*Attest:*

*Attesting Officer*

Q. TODD DICKINSON

*Acting Commissioner of Patents and Trademarks*